US005649414A

United States Patent [19]

Rawdon et al.

[11] Patent Number: 5,649,414

[45] Date of Patent: Jul. 22, 1997

[54] SLING WITH BRAIDED SLEEVE COVERING

[75] Inventors: Blaine K. Rawdon, Rancho Palos Verdes; James S. Wells, Fountain Valley; Myles A. Rohrlick, Oceanside, all of Calif.

[73] Assignee: McDonnell Douglas Corp., Huntington Beach, Calif.

[21] Appl. No.: 667,793

[22] Filed: Jun. 21, 1996

[51] Int. Cl.[6] ..... D02G 3/22; D02G 3/26

[52] U.S. Cl. ..... 57/201; 57/21; 57/22; 57/23; 87/6; 87/9; 87/13; 87/29; 87/30; 87/62

[58] Field of Search ..... 57/21, 22, 201, 57/23; 87/9, 6, 13, 29, 30, 62

[56] References Cited

U.S. PATENT DOCUMENTS

| | | | |
|---|---|---|---|
| 16,977 | 11/1857 | James | 87/29 |
| 1,312,770 | 8/1919 | Turner et al. | 87/2 |
| 1,587,856 | 6/1926 | Reed | 57/21 |
| 1,967,102 | 7/1934 | Schlegel | 57/21 |
| 3,036,490 | 5/1962 | Muller et al. | 87/6 |
| 3,707,021 | 12/1972 | Norrman | 24/16 R |
| 3,828,544 | 8/1974 | Alker | 87/6 |
| 4,640,178 | 2/1987 | Kurzbock | 87/6 |
| 4,640,179 | 2/1987 | Cameron | 87/6 |
| 4,741,087 | 5/1988 | Plummer, Jr. | 87/6 |
| 4,754,685 | 7/1988 | Kite et al. | 87/9 |
| 4,777,859 | 10/1988 | Plummer, Jr. | 87/9 |
| 4,843,807 | 7/1989 | von Danwitz | 57/201 |
| 5,060,549 | 10/1991 | Beal | 87/9 |
| 5,301,595 | 4/1994 | Kessie | 87/9 |

FOREIGN PATENT DOCUMENTS

| | | | |
|---|---|---|---|
| 235686 | 5/1974 | Germany | 87/6 |
| 2716056 | 10/1978 | Germany | 57/21 |
| 3295749 | 12/1988 | Japan | 87/6 |

*Primary Examiner*—Daniel P. Stodola
*Assistant Examiner*—Tina R. Taylor
*Attorney, Agent, or Firm*—Donald E. Stout

[57] ABSTRACT

A utility loop includes a loop of fiber which forms the loop core. The loop of fiber is made from a thread wrapped into a plurality of loops. The two loose ends of the thread can then optionally be tied together to form the loop of fiber. The outer loop cover of the utility loop is a tube of braided material, which surrounds loop of fiber. The tube of braided material has a tube axis running along a length of the tube of braided material. The tube of braided material includes a relatively small number of relatively large-diameter monofilament fibers, which are braided together in a tubular form. All of the relatively large-diameter mono-filament fibers are oriented to form acute angles with the tube axis. The two loose ends of the tube of braided material are connected together to form the utility loop. Specifically, a first opposing end of the tube of braided material is slipped over a second opposing end of the tube of braided material to thereby form an overlap. These two opposing ends are then secured together at the overlap.

11 Claims, 3 Drawing Sheets

12
50
34
52
18

60

Fig. 5
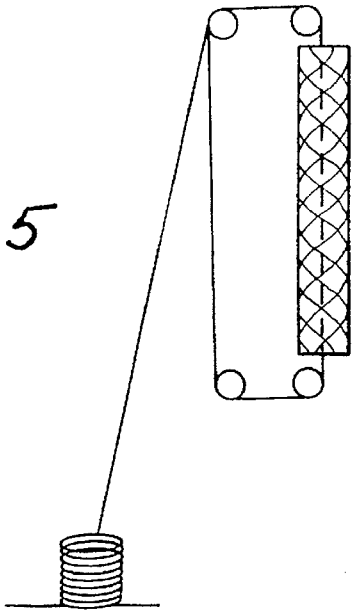
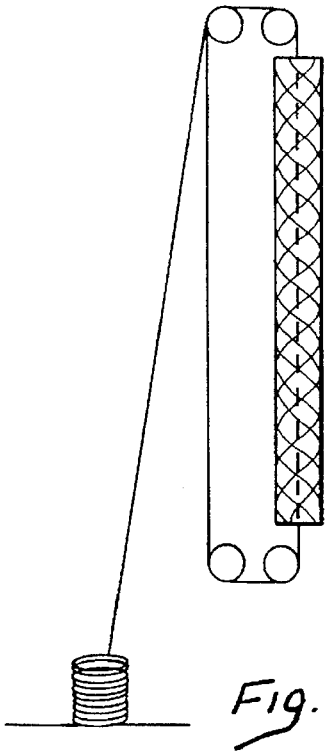
Fig. 6
Fig. 7a
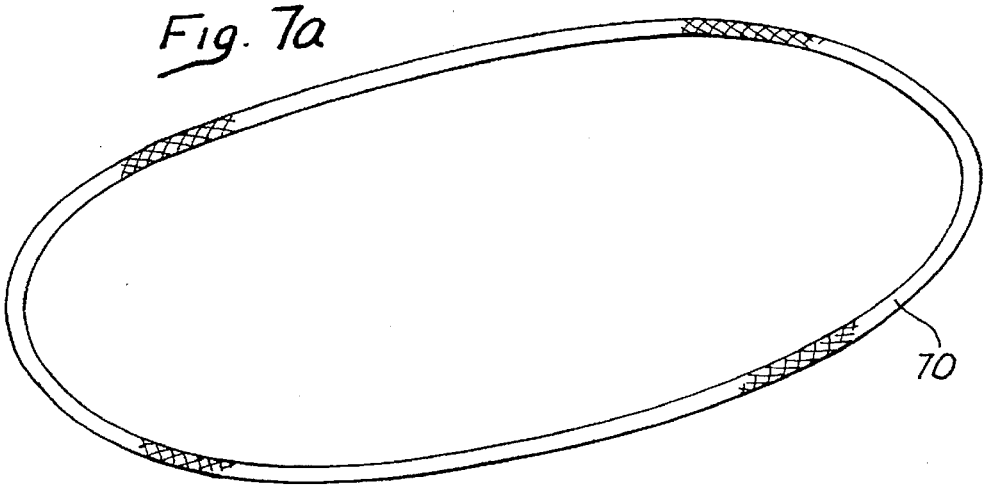
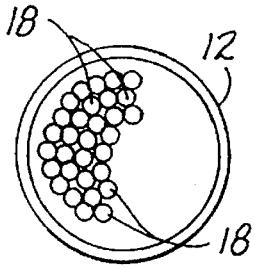
Fig. 7b

SLING WITH BRAIDED SLEEVE COVERING

BACKGROUND OF THE INVENTION

The present invention relates generally to utility loops, and more particularly, to a sling with a braided sleeve covering and a method for making the same.

A utility loop generally consists of a loop core and an outer covering. Utility loops may be used for a variety of purposes, including restraining cargo. Several utility loops may be linked together using chains, for example, to form greater lengths.

The loop core is usually formed of a strong fibrous core material. The loop core may be braided of multiple strands of fiber into a long, linear form. The braided loop core is then cut to a desired length, and the two ends are manually spliced together by interweaving the loose ends of the braided loop core. A utility loop may also be formed from a single strand of fibers by making multiple wraps around two or more pins. The two ends of the single strand can then be tied together to form a loop or, alternatively, can be left untied in which case friction serves to keep the loop together. Since the braided method of forming the loop core is manual, this method is relatively slow and expensive. The resulting splice from this method leaves an undesirable lump in the loop core, as well.

Additionally, a braided loop core is structurally inferior, since the angle of the braided fiber allows the loop core to change in length. Thus, extra tension must be applied to the braided loop core to remove slack and, further, the resulting braided loop core is not as rigid as might be desired.

The outer covering of the utility loop serves a function of protecting the loop core. In particular, the outer loop covering protects the loop core from abrasion, cuts, and ultraviolet degradation. The outer loop covering may take at least three forms. Specifically, the outer loop covering may be braided, woven, or molded. Molded outer loop covers, which are sufficiently abrasion and cut resistant, tend to be unacceptably stiff. Woven outer loop covers tend to be baggy and wrinkly, producing spots of high wear at the top of each wrinkle, for example.

U.S. Pat. No. 4,843,807, and German Patent No. 2,716,056, both disclose a woven outer loop cover. The woven outer loop cover is compressed in length over a semi-circular support by crumpling (bagging up) the outer loop cover. No significant increase in the diameter of the outer loop cover occurs as the outer loop cover is compressed in length and placed over the semi-circular support. The loop core is then formed within the compressed outer loop cover.

When the woven outer loop cover is removed from the semi-circular support and spread out over the length of the newly-formed loop core, the diameter of the woven outer loop cover remains unchanged. The result of this fixed diameter of the woven outer loop cover is a baggy outer loop cover. Thus, the inside of the outer loop cover is substantially larger than the space necessary to accommodate the loop core. This bagginess of the woven outer loop cover can inhibit secure knots from being formed, by wrinkling and hanging up in the tightening-up process. Making taut connections between the load and the vehicle, for example, is an element crucial to safety in the application of many utility loops which may be compromised. Additionally, a baggy outer loop cover adds excessive weight and volume to the utility loop, which reduces the number of utility loops that can be carried by a person and increases storage space in the vehicle, for example.

A utility loop consisting of a multiple-strand loop core and a braided outer loop covering is needed which is both durable, and which provides expansion characteristics to allow for a snug, yet flexible, fit of the braided outer loop cover over the multi-wrap loop core. Although the prior art has endeavored to braid an outer loop cover over an endless-loop core using a braiding machine, the engineering of the material and structure of the braided outer loop cover has been insufficient, and further, this braiding-in-place method of the prior art has been expensive because of the set-up time required to start and end each braid.

SUMMARY OF THE INVENTION

The present invention provides a braided outer loop cover, which provides both expansion capabilities and a snug fit over the inner loop core. The inner loop core, commonly referred to as a sling, is thus snugly held together by the braided outer loop cover. This snug fit of the braided outer loop cover over the inner loop core provides a smaller total diameter of the utility loop, which renders the overall utility loop more compact and less likely to tangle when connections are formed.

The utility loop of the present invention has an added advantage when the utility loop is passed over a small diameter pin or corner, for example. In such a case, the braided outer loop cover is free to increase in diameter at the corner to permit the loop core threads to spread out, which is their natural tendency. A tightly-fitted woven outer loop cover of the prior art would not allow the inner loop core threads to spread out around a corner, for example. In fact, such a woven outer loop cover would likely burst under the high loads applied by the strands of the inner loop core.

When the strands of the inner loop core are loaded in the present invention, each thread of the inner loop core is maintained at nearly the same length, since the threads are allowed to spread out. A tightly-fitted woven outer loop cover would not allow the threads to spread out, and some threads would be stretched more than others due to the high elastic modulus. Because of the absence of yielding, these stretched threads would break before other threads in the prior art loop core would be fully utilized. The effective strength of the prior art utility loop is thus considerably compromised.

The utility loop of the present invention includes a loop of fiber which forms the loop core. The loop of fiber is made from a thread wrapped into a plurality of loops. The two loose ends of the thread can then optionally be tied together to form the loop of fiber. The outer loop cover of the present invention is a tube of braided material, which surrounds the loop of fiber. The tube of braided material has a tube axis running along a length of the tube of braided material. The tube of braided material includes a relatively small number of relatively large-diameter mono-filament fibers, which are braided together in a tubular form. All of the relatively large-diameter mono-filament fibers are oriented to form acute angles with the tube axis. The two loose ends of the tube of braided material are connected together to form the utility loop. Specifically, a first opposing end of the tube of braided material is slipped over a second opposing end of the tube of braided material to thereby form an overlap. These two opposing ends are then secured together at the overlap.

The orientations of the relatively large-diameter mono-filament fibers with the tube axis form acute angles of approximately plus or minus 25 degrees with a line parallel to the tube axis. The tube of braided material is formed to have a relatively high strength and a relatively high modulus. The orientation of the relatively large-diameter mono-filament fibers facilitates an expansion and contraction feature. None of the relatively large-diameter mono-filament fibers are oriented perpendicularly to a line parallel to the tube axis. The actual orientation of these relatively large-diameter mono-filament fibers, relative to a line parallel to the tube axis, changes from an angle of approximately plus or minus 25 degrees to an angle of approximately plus or minus 65 degrees when the tube of braided material is compressed to approximately one-third of its original length. This compression also results in the diameter of the tube of braided material increasing by at least twofold.

The method of making the utility loop includes a step of compressing the tube of braided material to approximately one-third of an original uncompressed length and approximately twice the original uncompressed diameter. A first end of a thread is pulled through one end of the tube of material and out of the other end of the tube of material. Portions of the thread located near opposite ends of the compressed tube are placed onto respective wheel disks, and the free end of the thread is attached to a region of the thread that has not yet been pulled through the compressed tube. This forms a loop of the thread. The wheel disks are then rotated to cause the loop of thread to rotate so that regions of the thread not yet pulled through the tube are continuously pulled therethrough. This allows a plurality of the individual threads to pass through the tube, thus forming a plurality of loops around the tube.

After a desired number of loops is formed, the two loose ends of the thread can optionally be tied together, and the tube and loops of thread are removed. The tube is then decompressed, causing the length of the tube to increase by approximately threefold to completely cover the loop of fiber. Opposite ends of the decompressed tube are then connected together by inserting one end of the tube into the other end of the tube and securing the two tube ends at the overlap.

A tube-expanding apparatus is used to compress the tube of braided material before formation of the loop of fiber. The diameter of the tube-expanding apparatus is approximately twice as large as the original uncompressed diameter of the braided tube. The tube-expanding apparatus has a slot running along its length, which enables the braided tube of material and the loop of fiber to be removed from the tube-expanding apparatus.

The tube-expanding apparatus includes a tapered portion, which initially fits into the tube of braided material and then expands the tube of braided material to a diameter of the tube-expanding apparatus. According to one feature of the present invention, the tapered portion has a clip for holding the loose end of the thread. Thus, as the tapered portion is pushed through the tube of braided material, the loose end of the thread is also pulled through the tube of braided material, to thereby assist in forming the first loop of the loop of fiber.

The present invention, together with additional features and advantages thereof, may best be understood by reference to the following description taken in connection with the accompanying illustrative drawings.

Figure 3:
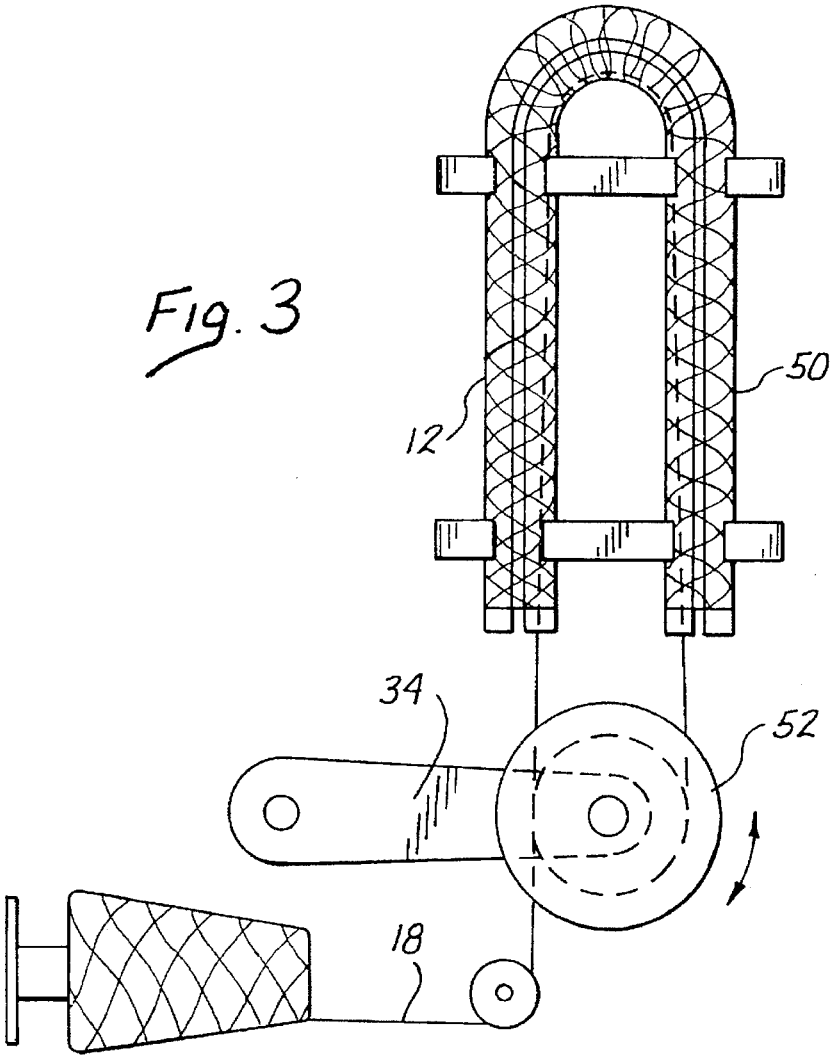
Figure 4:
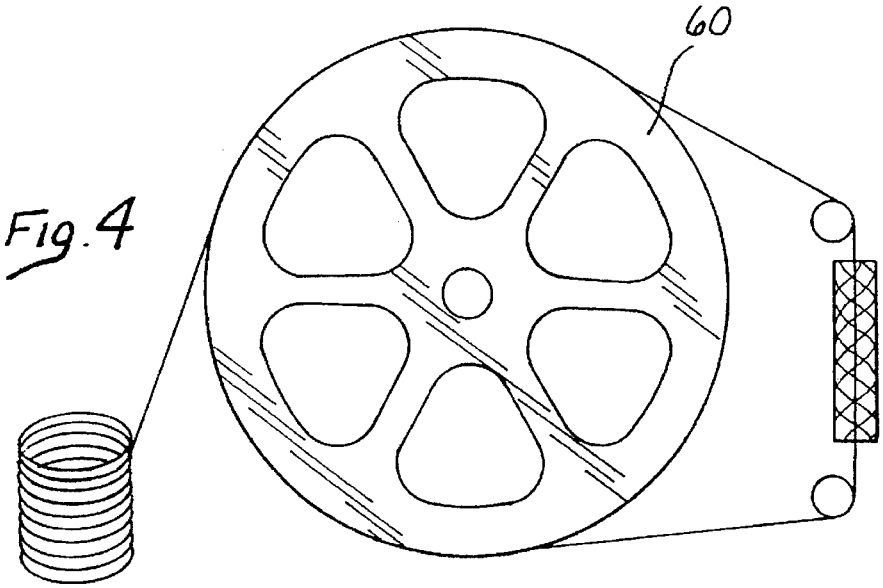

FIGS. *2a–2c* illustrate the tube-expanding apparatus of the presently preferred embodiment;

FIG. 3 illustrates an apparatus for making the utility loop according to an alternative embodiment;

FIG. 4 illustrates an apparatus for making the utility loop according to another alternative embodiment;

FIG. 5 illustrates an apparatus for making the utility loop of the present invention according to another alternative embodiment;

FIG. 6 illustrates an apparatus for making the utility loop of the present invention according to yet another alternative embodiment; and FIGS. *7a* and *7b* illustrate the utility loop of the presently preferred embodiment.

DETAILED DESCRIPTION OF THE PREFERRED EMBODIMENT

Figure 1:
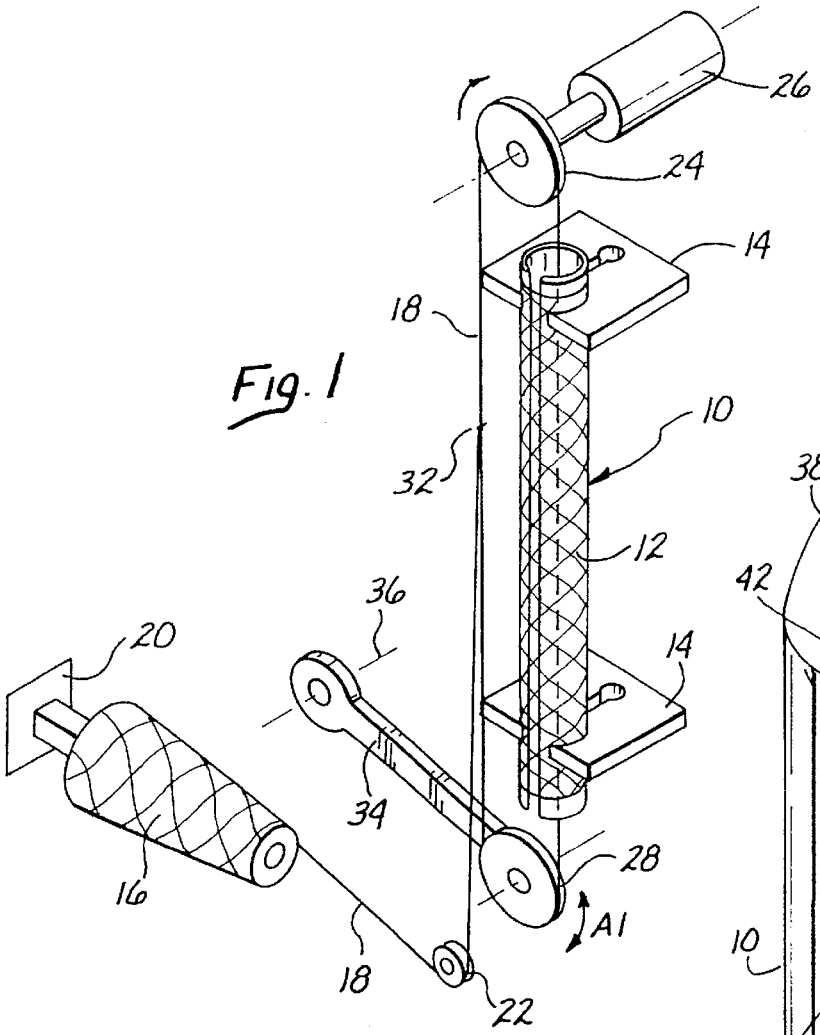
FIG. 1 is a perspective view of the apparatus for making the utility loop of the presently preferred embodiment.

Turning to FIG. 1, the apparatus for making the utility loop of the presently preferred embodiment is shown. A tube-expanding apparatus 10 fits within the compressed tube of braided material 12. The tube-expanding apparatus 10 preferably has a diameter, which is approximately twice the diameter of the tube of braided material 12 in an uncompressed state.

When the tube-expanding apparatus 10 is placed within the tube of braided material 12, the tube of braided material 12 is compressed in length and expanded in diameter. Once the tube of braided material 12 is placed over the tube-expanding apparatus 10, two tool attachment clips 14 are fitted around the tube of braided material 12 and the tube-expanding apparatus 10 to securely hold them together. The securing of the tube of braided material 12 to the tube expanding apparatus 10 may be by other means, such as clamps, for example, which do not penetrate the braid of the tube of braided material 12.

A thread supply spool 16 supplies thread 18, which is used to form the loop of fiber. The thread supply spool 16 is preferably secured to a wall with a support 20.

The thread 18 passes from the thread supply spool 16 over a tensioner 22, and then passes over a drive pulley 24. The drive pulley 24 is powered by a drive motor 26. Alternatively, the drive motor 26 may be replaced with a crank, for example. Once the thread 18 passes over the drive pulley 24, it passes through the compressed tube of braided material 12, and also through the tube-expanding apparatus 10. The thread 18 then passes over a pulley 28, which routes the thread 18 back up to the drive pulley 24.

After the thread 18 first passes through the compressed tube of braided material 12 and the tube-expanding apparatus 10, and passes around the pulley 28, the thread 18 is tied to a region that has not yet passed around the drive pulley 24. As presently embodied, this end of thread is attached using a knot 32.

A swing arm 34 pivots about an axis 36 to move the pulley 28 in opposite directions, indicated by the arrow A1. Movement of the pulley 28 in a direction toward the drive pulley 24 facilitates removal of the thread 18 after the desired number of loops have been made. In an alternative embodiment, the swing arm 34 may be replaced with a removable flange of the pulley 28 to thereby facilitate removal of the thread 18 from the utility loop making apparatus. A flange of the drive pulley 24 may also be removed, for example. The desired number of loops of the thread 18 may be obtained manually, or by an automatic loop-counting means. For example, a counting mechanism may be used to automatically stop the drive motor 26 when the correct number of loops of thread 18 have been made. This counting mechanism may comprise a mechanical switch operated by a gear cam, or a computer may control the drive motor 26 to stop when the predetermined number of loops has been achieved.

Figure 2B:
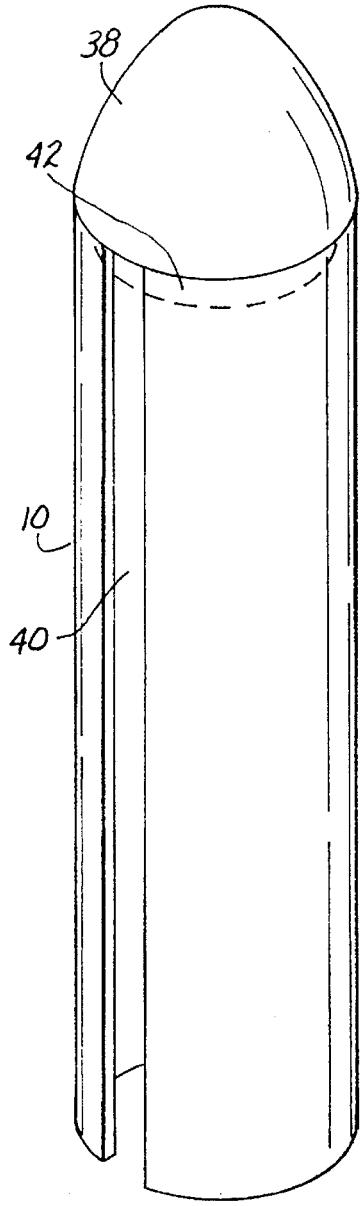
Figure 2C:
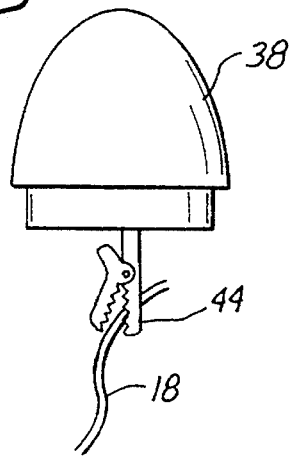
Figure 2A:
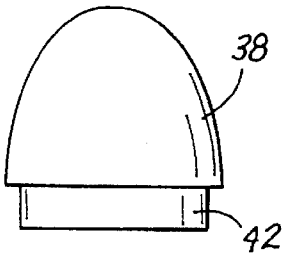

FIGS. *2a–2c* illustrate the tube-expanding apparatus 10 and a tapered portion 38 for fitting within the tube-expanding apparatus 10. The tube-expanding apparatus 10 is cylindrically shaped, with a slot 40 running along its length. The tapered portion 38 preferably comprises a separate piece having an inner portion 42 (FIG. 2*a*). The inner portion 42 has a diameter which is slightly less than the diameter of the tube expanding apparatus 10, to thereby facilitate insertion of the inner portion 42 into the tube-expanding apparatus 10. As presently embodied, the tapered portion 38 must be removable from the tube-expanding apparatus before the thread 18 is first passed through the compressed tube of braided material 12. Thus, the tapered portion 38 is preferably removed as soon as the compressed tube of braided material 12 is placed over the tube-expanding apparatus 10.

According to the presently preferred embodiment, a clip 44 (FIG. 2*c*) fits onto the tapered portion 38. The clip 44 accommodates an end of the thread 18, which is initially supplied from the thread supply spool 16. An upper area of the tapered portion 38 first fits into an end of the tube of braided material 12. The upper area of the tapered portion 38 is tapered from a small diameter to a diameter approximately the same as the diameter of the tube-expanding apparatus 10. Thus, as the tapered portion 38 is pushed further and further into the tube of braided material 12, the tube of braided material 12 is expanded to the diameter of the tube-expanding apparatus 10. The tapered portion 38 is pushed all of the way through the tube of braided material 12 to thereby enlarge the diameter of the tube of braided material 12, while simultaneously decreasing the length of the tube of braided material 12. Additionally, as the tapered portion 38 is moved through the tube of braided material 12, the clip 44 pulls the first end of the thread 18 through the tube of braided material 12.

The unique construction of the tube of braided material 12 allows for an expansion in the diameter of the tube of braided material 12 and a simultaneous compression in the length of the tube of braided material 12. The tube of braided material preferably comprises a relatively small number of relatively large-diameter synthetic mono-filament fibers. A woven tube, for example, is made of threads, which comprise extremely fine textiles. The relatively large-diameter synthetic mono-filament fibers of the presently preferred embodiment have a large diameter within a range of $^{5}/_{1000}$ and $^{20}/_{1000}$ inch. Other diameters, of course, may also be used according to materials and other design parameters.

These mono-filament fibers may comprise a polyester material having a relatively high strength and relatively high modulus. Such a braided material may be obtained from the Bentley Harris Manufacturing Company, for example. The relatively large-diameter mono-filament fibers of the tube of braided material may also comprise stainless steel. The stainless steel mono-filament fibers also have a relatively high strength and relatively high modulus and, additionally, may preferably have a diameter within the range of between $^{3}/_{1000}$ and $^{15}/_{1000}$ inch. According to still another preferred embodiment, the relatively large-diameter mono-filament fibers may comprise aluminum.

The relatively large-diameter mono-filament fibers prevent the tube of braided material 12 from buckling when the tube 12 is compressed. Also, the orientation and construction of these mono-filament fibers results in a low coefficient of friction therebetween. The unique configuration of the mono-filament fibers allows the tube of braided material 12 to be slipped easily onto the tube-expanding apparatus 10, as the tube of braided material 12 increases in diameter and decreases in length. The resulting benefit of this feature is the ability to almost completely fill the decompressed tube of braided material 12 with the loop of fiber upon removal from the tube-expanding apparatus. Specifically, as the compressed tube of braided material 12 is removed from the tube-expanding apparatus 10 and stretched around the loop of fiber, the diameter of the tube of braided material 12 decreases to snugly fit onto the loop of fiber. By adjusting the length and diameter of the tube of braided material 12 relative to the length and diameter of the loop of fiber, nearly any degree of tightness of the tube of braided material 12 about the loop of fiber may be achieved. Thus, the presently preferred embodiment allows for a utility loop with a snug, yet flexible outer loop cover. This snug, yet flexible outer loop cover is free to increase in local circumference at corners, to thereby permit the threads 18 in the loop of fiber to spread out, thereby reducing stress and strain on the threads 18 and prolonging the life of the loop of fiber.

Each mono-filament fiber of the tube of braided material 12 forms an acute angle with a line parallel to an axis running along the length of the tube of braided material 12. In the presently preferred embodiment, these acute angles are approximately plus or minus 25 degrees. When the tube of braided material 12 is compressed, however, these acute angles increase to approximately plus or minus 65 degrees. The compression and expansion capabilities of the tube of braided material 12 are partially attributable to the absence of any circumferential or looped mono-filament fibers, perpendicularly oriented with the tube axis.

The construction of the mono-filament fibers of the tube of braided material 12 thus allows the tube 12 to be compressed along its length to approximately one-third of its original length, and simultaneously expanded in diameter by at least twofold. In the presently preferred embodiment, the tube-expanding apparatus 10 facilitates this compression and expansion of the tube of braided material 12. Once the tube of braided material 12 is fitted over the tube-expanding apparatus 10, the tool attachment clips 14 (FIG. 1) secure the tube of braided material 12 and the tube-expanding apparatus 10 to the utility-loop making apparatus shown in FIG. 1.

The tube of braided material 12 and the tube-expanding apparatus 10 are secured by the tool attachment clips 14 to thereby align an axis of the tube of braided material 12 with circumferential surfaces of the pulley 28 and the drive pulley 24. The fiber tensioner 22 is aligned with the circumferential surface of the drive pulley 24. In production, a plurality of tube-expanding apparatus 10 may be used for the utility-loop making apparatus, to thereby allow for the insertion of one tube-expanding apparatus 10 into one tube of braided material 12, while another tube-expanding apparatus 10 and corresponding tube of braided material 12 are attached to the operating utility loop braiding apparatus.

If the clip 44 (FIG. 2*c*) is not used, the thread 18 may be fed from the thread supply spool 16 over the tensioner 22, over the circumferential surface of the drive pulley 24, and then threaded through the tube-expanding apparatus 10 with the aid of a needle or weight, for example. The thread exits the tube-expanding apparatus 10 and the compressed tube of braided material 12, and is brought around the circumferential surface of the pulley 28 and attached to a region of the thread 18 by a knot 32. This procedure, which omits use of the clip 44, may be useful when the size of the compressed tube of braided material 12 is relatively small or when the configuration of the tube-expanding apparatus 10 is relatively simple.

Once the knot 32 is formed, the drive motor 26 is activated to spin the drive pulley 24. The knot 32 is then rotated through the tube-expanding apparatus 10 and the compressed tube of braided material 12. As the knot 32 rotates, thread is pulled off of the thread supply spool 16 and builds up on the pulley 28 and the drive pulley 24. When the correct number of loops of thread 18 has been obtained, the drive motor 26 is stopped. The thread from the supply spool 16 is then cut at an appropriate spot, and the knot 32 is untied. These two loose ends of the thread 18 can then optionally be joined together using another knot (not shown), to thereby form a loop of fiber. If the two loose ends are not joined together, friction serves to keep the loop together.

In the presently preferred embodiment, the swing arm 34 (FIG. 1) is activated to move the pulley 28 toward the drive pulley 24, to thereby facilitate removal of the loop of fiber from around the circumference of the pulley 28. Additionally, the tube-expanding apparatus 10 is disconnected from the two tool attachment clips 14. Next, the compressed tube of braided material 12 is removed from the tube expanding apparatus 10 so that inner portions of the tube of braided material 12 contact around the loop of fiber.

The loop of fiber moves through the slot 40 in the tube-expanding apparatus 10, when the compressed tube of braided material 12 is removed from the tube expanding apparatus 10. According to the presently preferred embodiment, the loop of fiber may comprise 20 to 40 wraps of the thread 18. The resulting diameter of this loop of fiber may be approximately one-half inch to five-eights inch. The diameter of the thread 18 may be approximately between 1/16 and 1/8 inch. The thread 18 preferably comprises filaments, each having a diameter of approximately between 1/1000 and 10/1000 of an inch. This thread may comprise Tejin "Technora", Hoechst-Celanese "Vectran" or "Spectra." The nominal failure strength of this loop of fiber is preferably in the order of approximately 400,000 pounds per square inch, and the strain-to-failure ratio is about three percent. This loop of fiber has a relatively high strength and a relatively high modulus.

As mentioned, the tube of braided material 12 increases in length by approximately threefold, and increases in diameter by approximately twofold, upon removal from the tube-expanding apparatus 10. The tube of braided material 12 can thus be stretched out along the loop of fiber to completely cover the loop of fiber. The first end of the tube of braided material 12 is slipped over the other end of the tube of braided material 12 to thereby form an overlap. The raw, exposed end of the tube of braided material 12 may be taped or otherwise covered or sealed to inhibit unravelling. These two ends of the tube of braided material 12 are then connected at the overlap. It is noted that the tube of braided material 12 must expand in length by about two and one-half times in order to completely cover the loop of fiber, according to the presently preferred embodiment.

FIG. 3 illustrates the utility loop braiding system according to an alternative embodiment, where the tube-expanding apparatus 50 is U-shaped and a single pulley 52 is used. The single pulley 52 is sized so that its circumferential surfaces are aligned with the vertical sides of the U-shaped tube-expanding apparatus 50. The thread 18 is fed through the U-shaped tube-expanding apparatus 50 with a long, flexible needle, for example, and tied as before. The single pulley 52 drives the thread 18 through the U-shaped tube-expanding apparatus 50, with the curved interface 54 of the U-shaped tube-expanding apparatus 50 acting as a fixed pulley.

Operation of this alternative embodiment is otherwise similar to that described with reference to FIG. 1. This alternative embodiment, however, permits a tube of braided material 12, which has lower expansion and contraction characteristics, to be used. According to this alternative embodiment, the compressed tube of braided material 12 only needs to expand about 30 percent to completely cover the loop of fiber.

FIG. 4 illustrates another alternative embodiment where an enlarged drive pulley 60 is used. FIGS. 5 and 6 illustrate additional alternative embodiments where four pulleys are arranged in different configurations. FIG. 7*a* illustrates the completed utility loop 70 of the presently preferred embodiment, and FIG. 7*b* illustrates a cross section of the utility loop 70 shown in FIG. 7*a*. The tube of braided material 12 snugly fits around the threads 18.

Although exemplary embodiments of the invention have been shown and described, many other changes, modifications and substitutions, in addition to those set forth in the above paragraph, may be made by one having ordinary skill in the art without necessarily departing from the spirit and scope of this invention.

What is claimed is:

1. A method of making a sling covered with a braided sleeve, comprising the following steps:

inserting a tapered portion of the tube-expanding apparatus into the tube of material, to thereby expand a diameter of the tube of material to approximately twice as large, or larger, than an original, unexpanded diameter of the tube;

compressing the tube of material along a tube-axis of the tube of material, as a result of the insertion of the tapered portion of the tube-expanding apparatus into the tube of material, the compressing of the tube decreasing a length of the tube along the tube-axis to approximately one third of an original uncompressed length of the tube, the compressing of the tube also increasing a diameter of the tube by at least two-fold;

pulling a first end of a thread through the tube along the tube-axis;

placing portions of the thread, located near opposite ends of the compressed tube, over circumferences of respective wheel discs;

attaching a free end of the thread to a region of the thread that has not been pulled through the compressed tube of material to thereby form a loop of fiber around the tube of material;

rotating at least one of the respective wheel discs to thereby cause the loop of fiber to rotate so that regions of the thread not yet pulled through the tube are continuously pulled therethrough thereby allowing a plurality of individual threads to pass through the tube;

removing the tube and the plurality of individual threads passing therethrough from the wheel discs;

decompressing the tube to thereby completely cover the loop of fiber with the tube; and connecting the opposite ends of the decompressed tube together.

2. The method of making a sling covered with a braided sleeve according to claim 1, wherein the step of removing the tube is followed by a step of connecting the first end of the thread to the second end of the thread, and wherein the step of connecting the opposite ends of the decompressed tube together comprises a substep of slipping one of the opposite ends of the decompressed tube over the other of the opposite ends of the decompressed tube to thereby form an overlap, and securing the opposite ends of the decompressed tube at the overlap.

3. The method of making a sling covered with a braided sleeve according to claim 1, wherein the step of compressing the tube of material along the tube-axis comprises a substep of changing an orientation of fibers of the tube of material from approximately plus or minus 25 degrees with the tube-axis to approximately plus or minus 65 degrees with the tube-axis.

4. The method of making a sling covered with a braided sleeve according to claim 1, wherein the step of removing the tube and the plurality of individual threads passing therethrough from the wheel discs further comprises the substep of removing the tube from the tube-expanding apparatus, the plurality of individual threads within the tube being removed from the tube-expanding apparatus through a slot in the tube-expanding apparatus that runs parallel to the tube-axis.

5. The method of making a sling covered with a braided sleeve according to claim 1, wherein the step of pulling a first end of the thread through the tube along the tube-axis comprises the following substeps:

attaching the first end of the thread to the tapered portion of the tube-expanding apparatus, the tapered portion of the tube-expanding apparatus passing along the tube-axis as the tube is placed over the tube-expanding apparatus to thereby pull the first end of the thread through the tube along the tube-axis; and clamping the tube onto the tube-expanding apparatus.

6. An apparatus for assisting in the manufacture of a sling covered with a braided sleeve, the apparatus comprising:

a tube-expanding apparatus having an outer surface, a length, a diameter, and a slot running along a length of the tube-expanding apparatus, the tube-expanding apparatus fitting through a tube of material to thereby significantly increase a diameter of the tube and significantly decrease the length of the tube without any overlapping of the tube;

a tapered portion having a diameter, which is less than the diameter of the tube-expanding apparatus, the tapered portion fitting through the tube of material before the tube-expanding apparatus fits through the tube of material; and a thread-attaching apparatus for attaching an end of a thread to the tapered portion before the tapered portion is fitted through the tube of material.

7. The apparatus for assisting in the manufacture of a sling covered with a braided sleeve according to claim 6, wherein the tube-expanding apparatus causes the diameter of the tube to increase by at least two-fold and causes the length of the tube to decrease to approximately one third of an original uncompressed length of the tube.

8. An apparatus for assisting in the manufacture of a sling covered with a braided sleeve, the apparatus comprising:

a tube-expanding apparatus having two opposing ends, a length, and a slot running along a length of the tube-expanding apparatus between the two opposing ends, the tube-expanding apparatus further including a tapered portion disposed between the two opposing ends, the tube-expanding apparatus fitting through a tube of material to thereby significantly increase a diameter of the tube and significantly decrease the length of the tube without any overlapping of the tube, the diameter of the tube increasing by at least two-fold and the length of the tube decreasing to approximately one third of an original uncompressed length of the tube;

a supply spool for providing a supply of thread; and a drive pulley for routing the supply of thread into the tube-expanding apparatus, the drive pulley causing the thread to be routed through the tube a first time to thereby form an initial loop of the thread, and, after an end of the thread that has passed through the tube is secured to a region of the thread that has not passed through the tube, the drive pulley causing the thread to be routed through the tube subsequent times to thereby form a plurality of loops passing through the tube-expanding apparatus.

9. The apparatus for assisting in the manufacture of a sling covered with a braided sleeve according to claim 8, wherein the drive pulley has a diameter that is larger than the length of the tube-expanding apparatus.

10. The apparatus for assisting in the manufacture of a sling covered with a braided sleeve according to claim 8, wherein the tube-expanding apparatus is U-shaped, and wherein the drive pulley contacts the thread immediately before and immediately after the thread enters into and exits from the tube, respectively.

11. The apparatus for assisting in the manufacture of a sling covered with a braided sleeve according to claim 10, wherein the drive pulley has a diameter that is approximately equal to a distance between the two opposing ends of the U-shaped tube-expanding apparatus.

* * * * *